United States Patent [19]

Davidson et al.

[11] Patent Number: 5,032,102

[45] Date of Patent: Jul. 16, 1991

[54] TOY FIGURE HAVING WATER DISSOLVABLE CLOTHES AND FACIAL ELEMENTS

[75] Inventors: Liliane Davidson, Studio City, Calif.; George Dunsay, Boston, Mass.; Cathy Larson, Redondo Beach; Robin K. Smith, Long Beach, both of Calif.

[73] Assignee: Mattel, Inc., El Segundo, Calif.

[21] Appl. No.: 493,564

[22] Filed: Mar. 14, 1990

[51] Int. Cl.[5] ..... A63H 3/00; A63H 33/30; B32B 27/00; B32B 31/00

[52] U.S. Cl. ..... 446/268; 446/385; 446/472; 446/474; 428/286; 428/290; 156/155; 156/61; 427/155; 2/243 A

[58] Field of Search ..... 446/268, 295, 296, 304, 446/305, 385, 386, 387, 472, 474; 428/246, 286, 290, 913; 156/155, 61; 427/155, 154, 394; 2/243 A

[56] References Cited

U.S. PATENT DOCUMENTS

| | | | |
|---|---|---|---|
| 1,422,334 | 7/1922 | Biroscak | 446/296 |
| 1,739,098 | 12/1929 | Smith | 446/296 X |
| 2,469,589 | 5/1949 | Barricini | 446/268 X |
| 3,900,606 | 8/1975 | Mandell, Jr. | 427/155 |
| 4,285,155 | 8/1981 | Lewis | 446/296 X |
| 4,347,266 | 8/1982 | Norman et al. | 427/155 X |
| 4,373,292 | 2/1983 | Pelura | 446/268 |
| 4,738,647 | 4/1988 | Renger et al. | 446/491 X |
| 4,742,093 | 5/1988 | Sadler et al. | 427/155 X |
| 4,795,397 | 1/1989 | Stevens | 446/369 X |
| 4,948,585 | 8/1990 | Schlein | 428/286 X |

FOREIGN PATENT DOCUMENTS

| | | | |
|---|---|---|---|
| 2533134 | 3/1984 | France | 446/296 |
| 569774 | 11/1957 | Italy | 446/296 |

*Primary Examiner*—Robert A. Hafer
*Assistant Examiner*—D. Neal Muir
*Attorney, Agent, or Firm*—Roy A. Ekstrand

[57] ABSTRACT

A doll is fabricated of a combination of waterproof materials together with overlying fabric layers formed of a water dissolvable fabric. In addition, embodiments are shown in which facial appearance features are formed of a water dissolvable material to alter the facial appearance of the doll. In its intended use, the doll is immersed in a vessel of water causing the dissolvable fabric layers and dissolvable facial appearance elements to be completely removed from the doll exposing the underlying waterproof elements.

15 Claims, 2 Drawing Sheets

TOY FIGURE HAVING WATER DISSOLVABLE CLOTHES AND FACIAL ELEMENTS

FIELD OF THE INVENTION

This invention relates generally to doll and toy figures and particularly to doll and toy figures undergoing an appearance change during play.

BACKGROUND OF THE INVENTION

Through the years, toy dolls have provided a substantial portion of the amusement and entertainment devices used by young children in a variety of ages. While dolls have been fabricated in a variety of configurations, the most popular variety is fabricated to generally represent a young human or human infant. To provide for additional play and entertainment value in dolls and toy figures, fabricators have provided devices which simulate one or more of the typical human actions. Examples of such action dolls have included dolls which walk, talk, crawl, climb and mimic other human activities. In addition, dolls are often fabricated to be utilized in mimicking the various care activities carried on by a human mother with her infant. Examples of such care activity dolls include dolls which are fabricated to be bathed, fed or be repeatedly dressed. Additional dolls have been fabricated which simulate other infant activities such as wetting and diaper changing.

Despite the great number of dolls and play activities provided thereby, there arises a continuing need for ever more interesting and varied doll features. One aspect of doll feature enhancement which has been explored by practitioners in the art concerns providing dolls having changeable features of one type or another. An example of such changeable dolls is found in U.S. Pat. No. 4,257,188 issued to Barker which sets forth TOY DOLLS AND FIGURINES HAVING SURFACE PROPORTIONS OF REVERSIBLY CHANGEABLE COLOR in which toy dolls are shown having skins or exterior surfaces repeatedly capable of reversibly changing color. The skin is coated with a sealant primer base of hydrophobic material which in turn is covered with a color layer characterized by an acid base indicating material. A top coat is placed upon the acid base indicating material. The doll then may be exposed either to acidic or basic solutions which cause the coloring material to respond with color changes.

U.S. Pat. No. 2,921,407 issued to Wagner, et al. sets forth SIMULATING SUN BURNING TOY DOLLS AND FIGURINES which are coated with a light responsive material such that exposure to light changes the color appearance of the doll.

U.S. Pat. No. 3,858,351 issued to Porter sets forth a FIGURE TOY INJURY SIMULATING APPARATUS AND METHOD in which a plastic patch simulating a skin blemish or injury is placed on the outer surface of a doll or figure toys skin. A simulated bandage having a strong adhesive coating at its interior is placed upon the outer skin overlying the simulated injury. When the bandage is removed, the adhesive of the bandage adheres to the simulated injury patch with sufficient strength to pull the injury simulating patch leaving behind an unblemished skin surface having the appearance of being healed.

U.S. Pat. No. 2,959,891 issued to Barnett, et al. sets forth a DOLL which simulates various childhood injuries and illnesses such as measle spots, chicken pox or the gradual swelling of the throat associated with mumps. Means are provided for "treating " the doll's apparent abnormalities using miniaturized medical apparatus.

U.S. Pat. No. 408,609 issued to Freeland sets forth an ADVERTISING DEVICE in which a moving conveyor belt apparatus includes a path extending through a body of confined water. A human figure is disposed upon the moving conveyor belt and is carried through the water and thereafter out of view. Simulataneously, a second conveyor belt carries a simulated clean version of the same figure which appears to emerge from the water body having been cleaned.

U.S. Pat. No. 1,730,177 issued to VanCleave sets forth a DOLL FOR INSTRUCTION IN COLOR in which a yarn and string figure is provided with a head bearing a facial representation. The head portions of the dolls are coated with a layer of waterproof paint over which a watercolor paint is disposed. During immersion the watercolor portion of the paint is dissolved in the water coloring the same and permitting complimentary color combinations to instruct the user in color combinations.

U.S. Pat. No. 1,935,353 issued to Coventry sets forth a TOY having toy figures which are coated with a permanent water resisting coating. The toy figures are surface adapted to permit additional water soluble colors to be disposed on the toy figure and removed therefrom on a repetitive basis.

U.S. Pat. No. 2,445,994 issued to Benson, et al. sets forth a TOY formed of a cotton washcloth utilizing certain dyes which change color when exposed to different pH solutions.

U.S. Pat. No. 2,931,136 issued to Loewy sets forth DOLL HEADS which change complexion by manipulation of the doll from one position to another. The doll head portion is filled with various liquids having different colors and having diffent specific gravities which present different colorings within the facial area of the doll in response to positional changes.

U.S. Pat. No. 3,238,599 issued to Bauman sets forth a PADDING METHOD for use in fabricating a doll figure.

While the foregoing described prior art dolls provide some changeable features which enhance the amusement and play value of dolls and toy figures, there remains a continuing need in the art for ever more increasing amusement and play value in dolls and toy figures.

SUMMARY OF THE INVENTION

Accordingly, it is a general object of the present invention to provide an improved doll. It is a more particular object of the present invention to provide an improved doll having a changeable appearance.

In accordance with the present invention, there is provided a doll having a changeable appearance comprises: a doll body formed of a water resistant material; and an outer garment enclosing a portion of the doll body formed of a water dissolvable material for concealing a portion of the doll body or altering the appearance of the doll until the doll is immersed in water.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
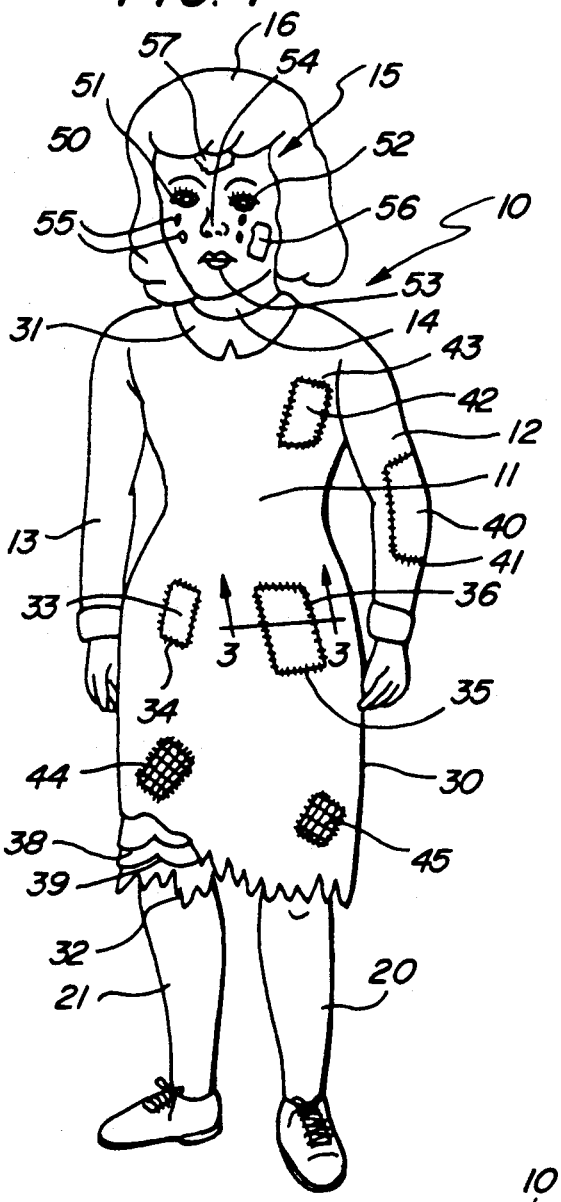
FIG. 1 sets forth a front view of a doll constructed in accordance with the present invention.

FIG. 1 sets forth a front view of a doll constructed in accordance with the present invention and generally referenced by numeral 10. Doll 10 depicts the figure of a young girl and defines a torso 11, a pair of arms 12 and 13, a neck 14, a head 15 and a pair of legs 20 and 21. Head 15 further supports a quantity of simulated hair 16 and a face 50. Face 50 in turn defines typical features of a young girl including a mouth 53, a nose 54, and a pair of eyes 51 and 52. In addition and in accordance with the present invention, face 50 further supports a plurality of simulated tears 55 extending downwardly in simulated droplets from eyes 51 and 52. In further accordance with the present invention, face 50 also supports simulated dirt smudges 56 and 57.

A dress 30 constructed in accordance with the present invention is fitted upon doll 10. In accordance with the present invention, dress 30 includes an outer lamination 37 and an inner lamination 38. Outer lamination 37 supports a plurality of simulated patches 33, 35, 40 and 42. A corresponding plurality of simulated stitches 34, 36, 41 and 43 give the appearance of securing patches 33, 35, 40 and 42 respectively to outer lamination 37. In addition, outer lamination 37 includes a pair of simulated dirt smudges 44 and 45. Inner lamination 38 is better seen in FIG. 2. However, suffice it to note here that in accordance with an important aspect of the present invention, inner lamination 38 is free of simulated patches and is fabricated to present an attractive bright and appealing dress.

In accordance with the present invention, outer lamination 37 including patches 33, 35, 40 and 42 as well as dirt smudges 44 and 45 are fabricated of a fabric which is readily dissolved in water. Similarly, simulated dirt smudges 56 and 57 as well as tears 55 are formed of a material readily dissolved in water. Conversely, inner lamination 38 is formed of a waterproof fabric which is resistant to water and not dissolved thereby. Thus in accordance with an important aspect of the present invention, doll 10 assumes the appearance shown in FIG. 1 initially in which doll 10 shows a young girl wearing a tattered and dirt smudged dress having a plurality of dirt smudges and tears upon the doll's face. In further accordance with the present invention, doll 10 is then immersed into a vessel of water causing outer lamination 37 to dissolve revealing inner lamination 38 completely. Concurrently, the immersion of doll 10 into a vessel of water causes tears 55 as well as dirt smudges 56 and 57 to be similarly dissolved within the bathing water. Since outer lamination 37 as well as patches 33, 35, 40 and 42 together with tears 55 and dirt smudges 44, 45, 56 and 57 are completely dissolved by the immersion of doll 10 into the water vessel, doll 10 when removed from the water appears transformed in appearance and assumes the appearance shown in FIG. 2.

Figure 2:
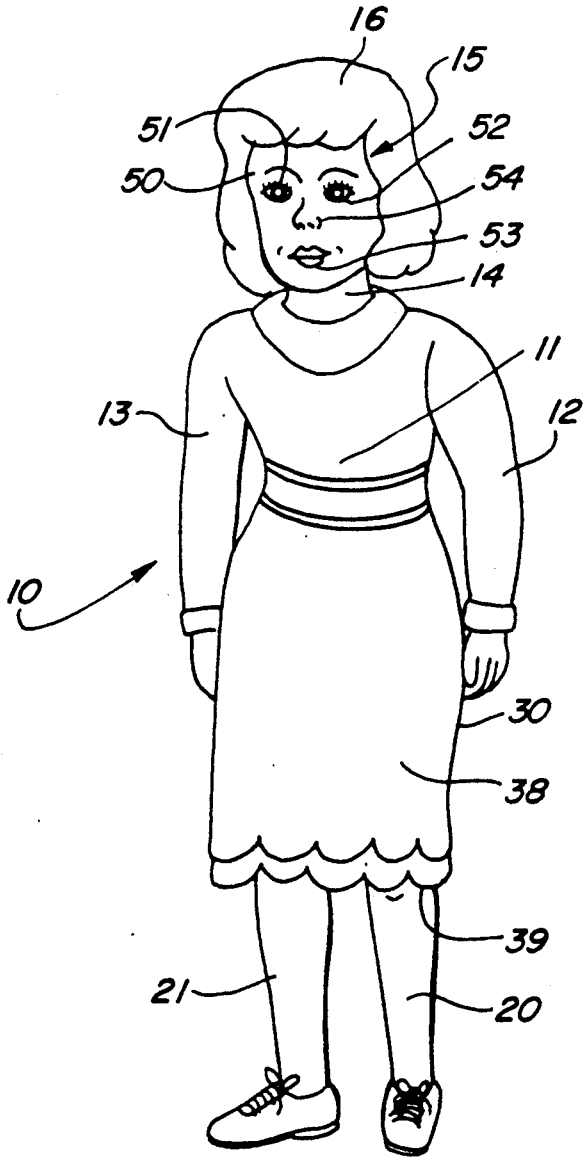
FIG. 2 sets forth a front view of the doll of FIG. 1 in an alternate configuration.

FIG. 2 sets forth a front view of the present invention doll having been transformed by immersion in water as described above. Doll 10 retains a torso 11, a pair of arms 12 and 13, a neck 14 and a head 15. Head 15 supports a quantity of simulated hair 16. Torso 11 supports legs 20 and 21 and is covered by a dress 30. Dress 30 is, as the result of dissolving outer lamination 37 in water, completely formed of inner lamination 38. The latter is completely exposed showing a clean bright appearance including a decorative hemline 39. Head 15 supports a face 50 which defines a pair of eyes 51 and 52, a mouth 53 and a nose 54. In accordance with the above-described water immersion, face 50 is completely free of simulated dirt smudges 56 and 57 as well as simulated tears 55.

As a result, comparison of FIGS. 1 and 2 shows that doll 10 has been transformed in appearance by its immersion within a vessel of water. It will be apparent to those skilled in the art that the appearance of outer lamination 37 and inner lamination 38 is merely exemplary and additional combinations of a water soluble or water dissolvable outer layer and a different appearing inner layer of waterproof fabric may be utilized without departing from the spirit and scope of the present invention. Similarly, while face 50 is shown having certain dissolvable appearance objects thereon, it will be apparent to those skilled in the art that additional combinations of dissolvable facial appearance elements may be utilized without departing from the spirit and scope of the present invention. So long as face 50 is fabricated of a waterproof material and the facial appearance elements such as tears 55 and dirt smudges 56 and 57 are fabricated of a water dissolvable material, the present invention doll may be utilized as described.

Figure 3:
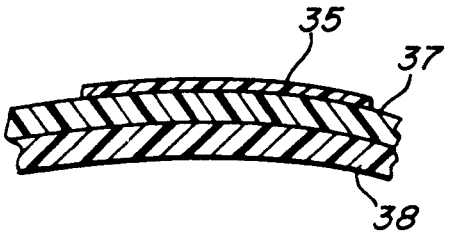
FIG. 3 sets forth a partial section view of the present invention doll taken along section lines 3—3 in FIG. 1.

FIG. 3 sets forth a partial section view of dress 30 taken along section lines 3—3 in FIG. 1. The important aspect to note in FIG. 3 is that inner layer 38 is formed of a waterproof material and underlies outer layer 37 as described above. A simulated patch 35 is supported upon the outside surface of outer lamination 37. As described above and in accordance with an important aspect of the present invention, outer lamination 37 and simulated patch 35 are both formed of a fabric which readily dissolves in water. Thus, in accordance with the present invention, the immersion of dress 30 causes outer lamination 37 and simulated patch 35 to dissolve completely and be completely removed from inner lamination 38.

Figure 4:
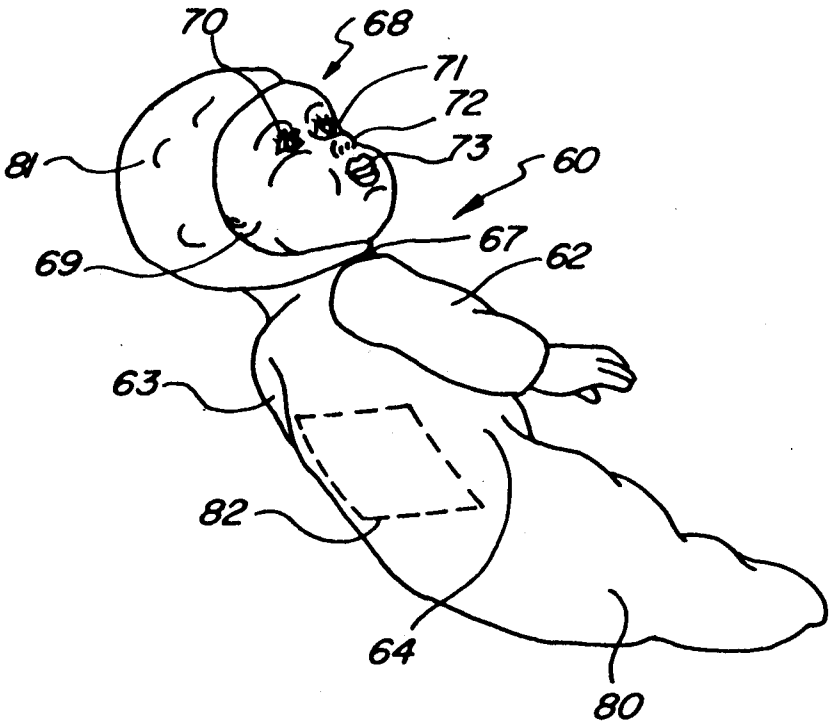
FIG. 4 sets forth a side view of an alternate embodiment of the present invention doll.

FIG. 4 sets forth an alternate embodiment of the present invention doll generally referenced by numeral 60. Doll 60 is fabricated to replicate a newborn human infant and as such includes a head 61, a neck 67, a torso 64 and a pair of arms 62 and 63. Head 61 further defines an infant face 68 having an ear 69, a pair of eyes 70 and 71, a nose 72 and a mouth 73. A bonnet 81 is tightly fitted to head 61 and encircles neck 67 for attachment. In accordance with the present invention, doll 60 further includes an outer bunting 80 which covers arms 62 and 63, torso 64 as well as legs 65 and 66 (the latter seen in FIG. 5). In addition, bunting 80 further supports a sealed interior pouch 82 described below. In accordance with an important aspect of the present invention, bonnet 81 completely covers all of head 61 but for face 68 and is formed of a water dissolvable fabric. Similarly, in further accordance with the present invention, outer bunting 80 is formed of a water dissolvable fabric. Seal pouch 82, however, is formed of a waterproof material and as described below in greater detail, supports a plurality of articles which are preserved from exposure to water during the immersion of doll 60. Outer bunting 80 and bonnet 81 are, in their preferred form, designed to be relatively nondescript and free of indications as to the gender of doll 60. Accordingly, doll 60 in the initial configuration shown in FIG. 4 may alternatively be a boy or girl. Pouch 82 is completely contained within outer bunting 80 and thus is not observable prior to immersion of doll 60.

Figure 5:
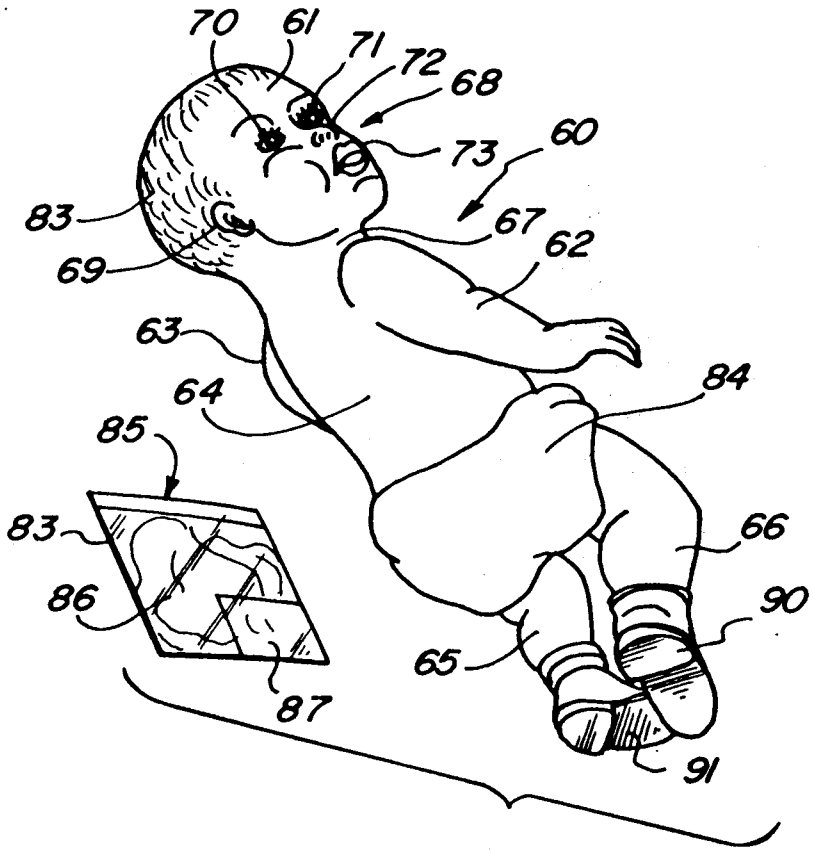
FIG. 5 sets forth the alternate embodiment of FIG. 4 in a changed configuration.

FIG. 5 depicts doll 60 following the immersion of doll 60 in a container of water. When so immersed, outer bunting 80 and bonnet 81 are completely dissolved into the water revealing the waterproof portions of doll 60. Thus following immersion, doll 60 includes a torso 64 having a pair of arms 62 and 63, a pair of legs 65 and 66, a neck 67 and a head 61. Head 61 supports a quantity of simulated hair 83 which may alternatively be configured to represent the hair of an infant boy or infant girl. Head 61 further defines a face 68 which includes a pair of eyes 70 and 71, a nose 72, a mouth 73 and an ear 69. In accordance with the invention, the entire infant figure of doll 60 is formed of a waterproof material. Accordingly, the above-described immersion dissolves only outer bunting 80 and bonnet 81 revealing doll 60 in the configuration shown in FIG. 5. A diaper 84 formed of a waterproof material is supported upon torso 64 and legs 65 and 66 to simulate an infant's diaper. A pair of booties 90 and 91 are also formed of a waterproof material and thus remain upon legs 65 and 66 of doll 60.

As described above, sealed pouch 82 is formed of a waterproof material and defines an interior pocket 85. Interior pocket 85 is completely sealed within pouch 82 and thus is not exposed to water during the immersion process. A garment 86 and a printed "birth certificate" are enclosed within interior pocket 85 of sealed pouch 82. In accordance with the present invention, garment 86 and printed birth certificate 85 together with hair 83 are coordinated to represent items associated with a boy or girl human infant. Thus in accordance with the present invention, garment 85 and printed birth certificate 87 may be removed from pouch 82 following the immersion process at which point the user becomes aware of the gender of doll 60. The surprise aspect of this revelation of the gender of doll 60 provides additional amusement and entertainment value for the user. It will be apparent to those skilled in the art that additional articles may be protected within interior pocket 85 of sealed pouch 82 without departing from the spirit and scope of the present invention.

Thus with reference to FIGS. 4 and 5 concurrently, the present invention doll shown therein is initially presented to the user as a partially concealed infant, the gender and name of which are unknown to the user at the initial time. Once doll 60 is immersed into a vessel of water, outer bunting 80 and bonnet 81 are dissolved completely releasing sealed pouch 82 and exposing doll 60 in the manner shown in FIG. 5. Thereupon, sealed pouch 82 is exposed and the user extracts printed birth certificate 87 and garment 86 for the surprise information as to the name and gender of doll 60. Because garment 86 and printed birth certificate 87 are protected within sealed pouch 82 during the water immersion process, they may be fabricated from materials which need not be waterproof and wetting thereof may be avoided.

What has been shown is a doll having changeable appearance which utilizes a combination of dissolvable and waterproof materials to provide dramatic changes in doll appearance during a water immersion process. In addition, the present invention doll provides for the concealment and ultimate release of a sealed information packet which adds to the amusement and play value of the present invention doll.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A doll having a changeable appearance comprising:

a doll body formed of a water resistant material; and an outer garment enclosing a portion of said doll body formed of a water dissolvable material for concealing a portion of said doll body and altering the appearance of said doll until said doll is immersed in water.

2. A doll as set forth in claim 1 wherein said doll body replicates a human infant and wherein said outer garment forms a bunting.

3. A doll as set forth in claim 2 wherein said outer garment includes a bonnet formed of a water dissolvable material.

4. A doll as set forth in claim 3 further including a sealed pouch having a water-tight interior pocket, said sealed pouch being formed of a waterproof material and being concealed within said bunting.

5. A doll as set forth in claim 4 further including a garment and a printed document supported within said interior pocket.

6. A doll as set forth in claim 5 wherein said document is a simulated birth certificate for said doll.

7. A doll as set forth in claim 1 wherein said outer garment includes an inner lamination formed of a water resistant material and having an appearance different from said outer garment.

8. A doll as set forth in claim 7 wherein said outer garment appears to be a patched and tattered dress and wherein said inner lamination appears to be dress free of patches and tatters.

9. A doll as set forth in claim 8 wherein said doll body includes a face, said doll further including a plurality of simulated objects on said face formed of a water dissolvable material.

10. A doll as set forth in claim 9 wherein said simulated objects appear to be tears and dirt smudges.

11. A doll having a changeable appearance comprising:

a doll body having a face portion formed of a water resistant material and resembling a young child;

a garment formed of a first outer layer of water dissolvable fabric and a second inner layer of water resistant fabric; and a plurality of opaque areas visibly distinguishable from and supported by said face portion and formed of a water dissolvable material.

12. A doll as set forth in claim 11 wherein said doll resembles a young girl and wherein said garment forms a dress.

13. A doll as set forth in claim 12 wherein said first outer layer of said dress appears old, patched and tattered and wherein said second inner layer of said dress appears new and clean.

14. A doll as set forth in claim 13 wherein said appearance objects include simulated tears and dirt smudges.

15. A toy figure having a changeable appearance comprising:

a toy figure body formed of a water resistant material and having a first appearance; and an outer covering garment formed of a water dissolvable material covering a portion of said body and having a second appearance differing from said first appearance.

* * * * *